US009207621B2

(12) United States Patent
Yamaguchi

(10) Patent No.: US 9,207,621 B2
(45) Date of Patent: Dec. 8, 2015

(54) PRINTER, DATA PROCESSING APPARATUS, AND METHOD OF CONTROLLING DATA PROCESSING APPARATUS

(71) Applicant: Oki Data Corporation, Tokyo (JP)

(72) Inventor: Yasunaga Yamaguchi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/529,629

(22) Filed: Oct. 31, 2014

(65) Prior Publication Data

US 2015/0125174 A1 May 7, 2015

(30) Foreign Application Priority Data

Nov. 1, 2013 (JP) ..... 2013-228569

(51) Int. Cl.
*G03G 15/00* (2006.01)
*G03G 15/20* (2006.01)

(52) U.S. Cl.
CPC ..... *G03G 15/80* (2013.01); *G03G 15/5004* (2013.01); *G03G 15/2003* (2013.01); *G03G 15/2078* (2013.01); *G03G 2215/00983* (2013.01)

(58) Field of Classification Search
CPC ..... G03G 15/00
USPC ..... 399/88
See application file for complete search history.

(56) References Cited

U.S. PATENT DOCUMENTS

2006/0024079 A1* 2/2006 Sato et al. ..... 399/88
2011/0311237 A1* 12/2011 Hotogi ..... 399/9
2013/0223867 A1* 8/2013 Nakamura et al. ..... 399/88

FOREIGN PATENT DOCUMENTS

JP 2005-035227 * 2/2005 ..... G03F 21/00
JP 2005-035227 A 2/2005
JP 2010-050820 * 3/2010 ..... G03G 15/20

* cited by examiner

*Primary Examiner* — Clayton E Laballe
*Assistant Examiner* — Kevin Butler
(74) *Attorney, Agent, or Firm* — Marvin A. Motsenbocker; Mots Law, PLLC

(57) ABSTRACT

A method of controlling a data processing apparatus including: a drive system device; a data processing device configured to perform data processing; and a power supply circuit configured to generate a drive system voltage to be supplied to the drive system device and a data processing system voltage to be supplied to the data processing device, from an input voltage from an external power supply. The method comprises: when an interruption of the input voltage is detected, switching an operation mode to a power saving mode in which the drive system device is stopped or restrained from driving, and then executing a protective operation for the data processing device.

26 Claims, 10 Drawing Sheets

FIRST EMBODIMENT

FIRST EMBODIMENT

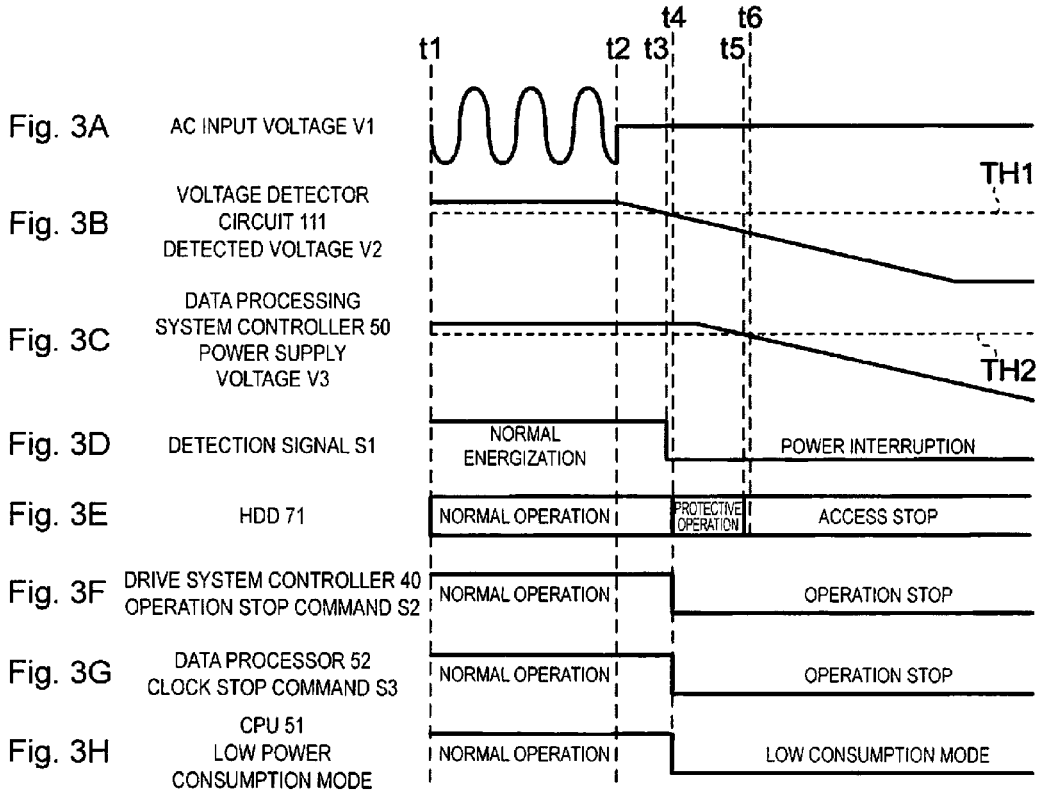
FIRST EMBODIMENT

COMPARATIVE EXAMPLE

FIRST EMBODIMENT

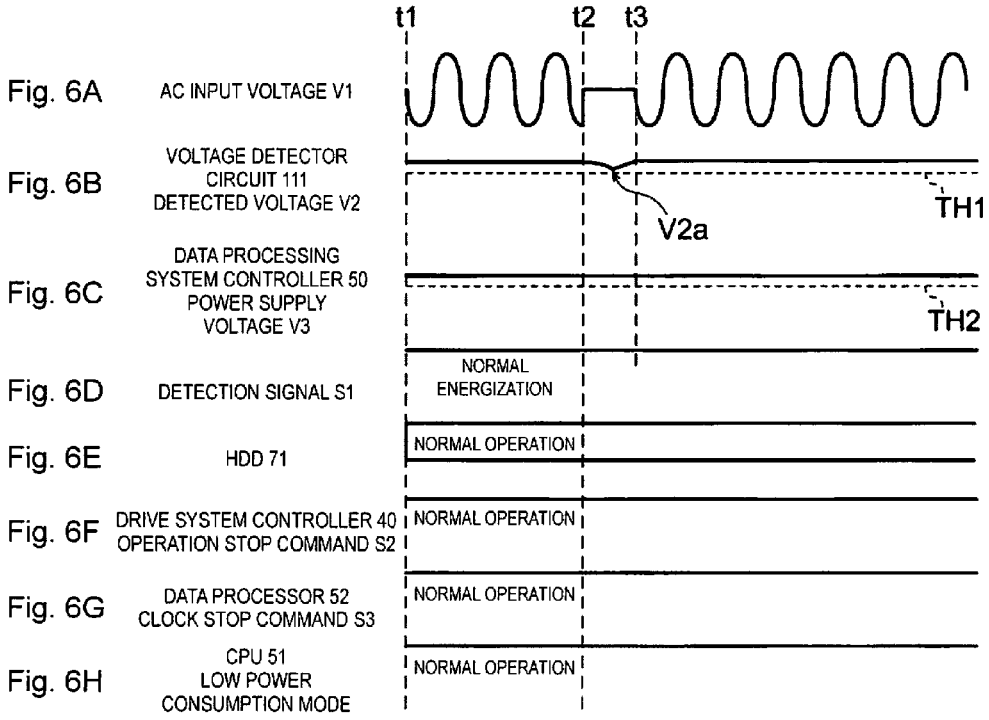
FIRST EMBODIMENT

SECOND EMBODIMENT

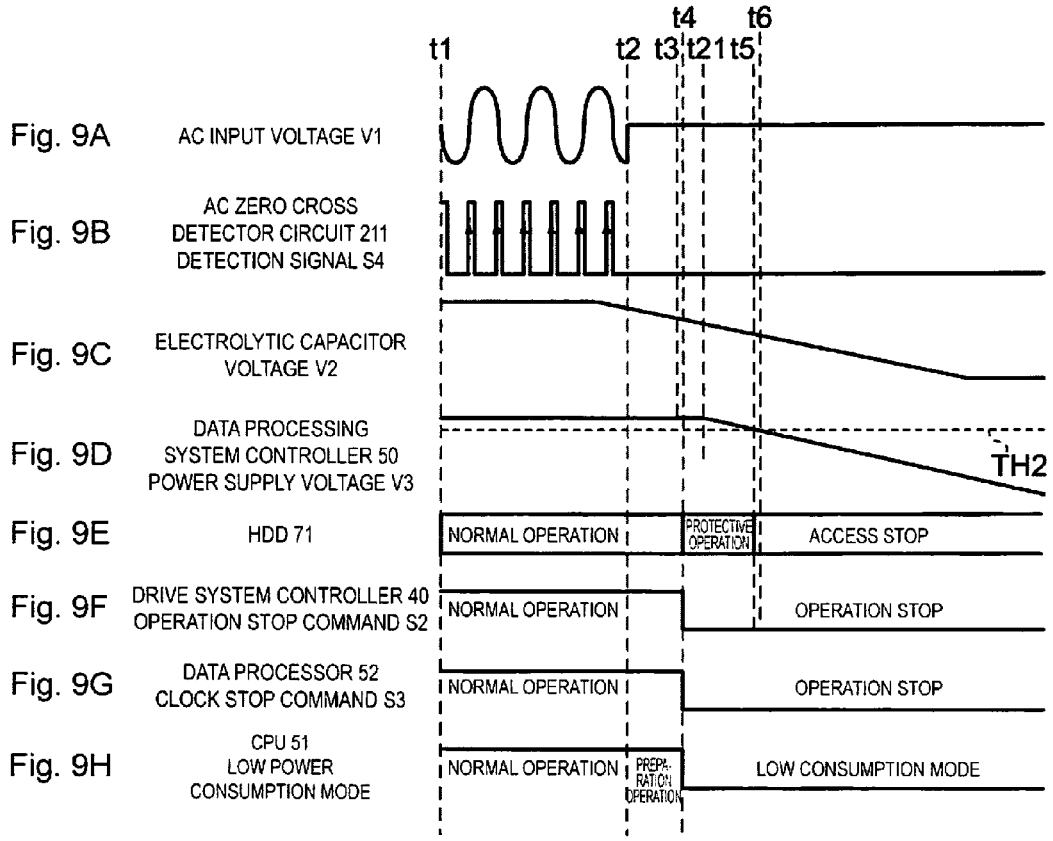
SECOND EMBODIMENT

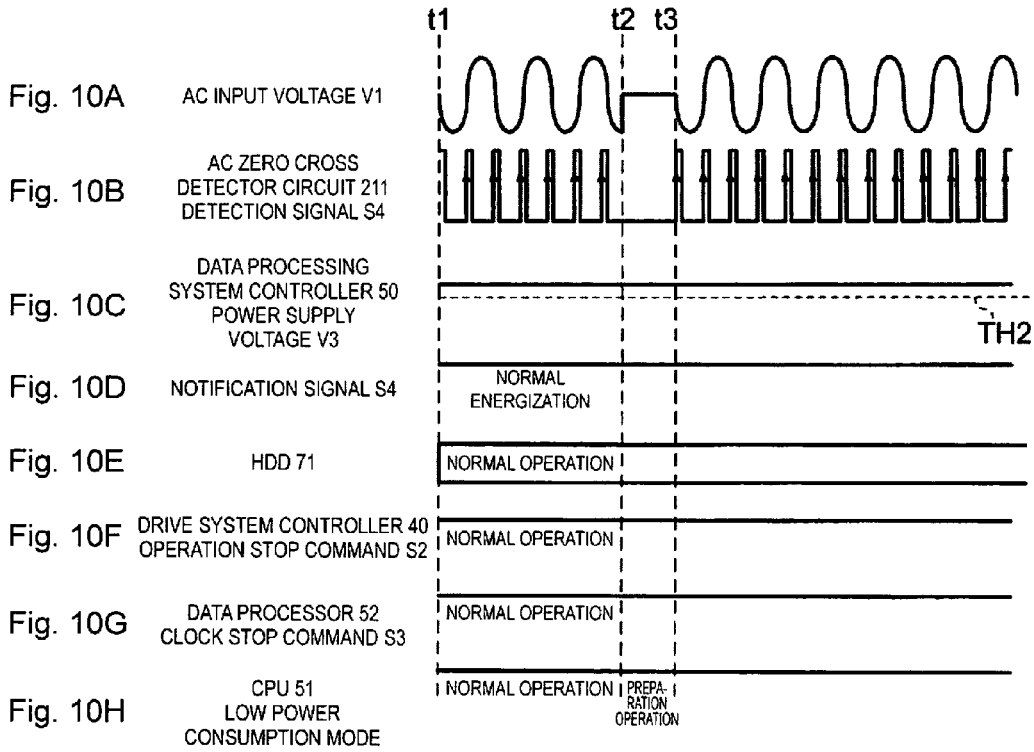
SECOND EMBODIMENT

PRINTER, DATA PROCESSING APPARATUS, AND METHOD OF CONTROLLING DATA PROCESSING APPARATUS

CROSS REFERENCE TO RELATED APPLICATIONS

This application claims priority based on 35 USC 119 from prior Japanese Patent Application No. 2013-228569 filed on Nov. 1, 2013, entitled "PRINTER, DATA PROCESSING APPARATUS, AND METHOD OF CONTROLLING DATA PROCESSING APPARATUS", the entire contents of which are incorporated herein by reference.

BACKGROUND OF THE INVENTION

1. Field of the Invention

This disclosure relates to a printer including a data processing device, a data processing apparatus, and a method of controlling a data processing apparatus.

2. Description of Related Art

Heretofore, a printer equipped with a data processing device such as a hard disk drive (HDD) has been widespread. Typically, such a printer includes a protective unit configured to execute a protective operation intended to prevent physical damage to the data processing device and save data (for example, data temporarily stored in a cache memory) not yet written to a storage unit (for example, a disk of the HDD) of the data processing device at the interruption of an alternating current (AC) input voltage. For example, Patent Literature 1 (Japanese Patent Application Publication No. 2005-35227) discloses that, at the interruption of the AC input voltage, data is saved in the storage unit (for example, the disk of the HDD) of the data processing device and an operation moves to a shut-down operation for the printer. Such a protective operation is executed by using electric power (or electric energy) stored in an electrolytic capacitor included in a low-voltage power supply circuit, when a detector circuit detects a decrease in the AC input voltage.

SUMMARY OF THE INVENTION

However, the amount of electric power storable in the electrolytic capacitor is limited. Using a large-capacitance capacitor as the electrolytic capacitor included in the low-voltage power supply circuit produces problems as given below. Firstly, manufacturing costs of the apparatus rise. Secondly, it is necessary to increase the volumetric capacity of a power supply unit equipped with the low-voltage power supply circuit. Thirdly, an inrush current generated at the input of the AC input voltage (or at the turn-on of a power switch of the apparatus) is large.

On the other hand, using a small-capacitance capacitor as the electrolytic capacitor included in the low-voltage power supply circuit produces problems as given below. When an operation having high power consumption (for example, a printing operation) is ongoing at the interruption of the AC input voltage, electric power stored in the electrolytic capacitor is consumed in a short time, and a voltage maintained by the electric power stored in the electrolytic capacitor becomes lower than an operation limit voltage of the data processing device in a short time. As a result, a situation arises where the protective operation for the data processing device cannot be completed.

An object of an embodiment of the invention is to ensure a sufficient time for a protective operation for a data processing device after an interruption of the power supply without involving an increase in the amount of electric power storable in a power supply circuit.

A first aspect of the invention is a printer that comprises: a drive system device configured to perform a printing operation; a drive system controller configured to control the drive system device; a data processing device configured to perform data processing; a data processing system controller configured to control the data processing device; a power supply circuit configured to generate a drive system voltage to be supplied to the drive system controller and a data processing system voltage to be supplied to the data processing system controller, from an input voltage supplied by an external power supply; and an input voltage detector configured to transmit a detection signal indicating an interruption of the input voltage to the data processing system controller, when the input voltage is interrupted in a first operation mode in which the voltages are supplied to the drive system controller and the data processing system controller. Upon receipt of the detection signal indicating the interruption of the input voltage, the data processing system controller switches at least one of a predetermined portion in the data processing system controller and the drive system controller to a second operation mode in which power consumption is lower than that in the first operation mode, and executes a protective operation for the data processing device.

A second aspect of the invention is a data processing apparatus that comprises: a drive system device; a drive system controller configured to control the drive system device; a data processing device configured to perform data processing; a data processing system controller configured to control the data processing device; a power supply circuit configured to generate a drive system voltage to be supplied to the drive system controller and a data processing system voltage to be supplied to the data processing system controller, from an input voltage supplied by an external power supply; and an input voltage detector configured to transmit a detection signal indicating an interruption of the input voltage to the data processing system controller, when the input voltage is interrupted in a first operation mode in which the voltages are supplied to the drive system controller and the data processing system controller. Upon receipt of the detection signal indicating the interruption of the input voltage, the data processing system controller switches at least one of a predetermined portion in the data processing system controller and the drive system controller to a second operation mode in which power consumption is lower than that in the first operation mode, and executes a protective operation for the data processing device.

A third aspect of the invention is a method of controlling a data processing apparatus including: a drive system device; a data processing device configured to perform data processing; and a power supply circuit configured to generate a drive system voltage to be supplied to the drive system device and a data processing system voltage to be supplied to the data processing device, from an input voltage from an external power supply. The method comprises: when an interruption of the input voltage is detected, switching an operation mode to a power saving mode in which the drive system device is stopped or restrained from driving, and then executing a protective operation for the data processing device.

According to the above-described aspect(s), the invention can ensure a sufficient time for a protective operation for a data processing device after an interruption of the power supply, without involving an increase in the amount of electric power storable in the power supply circuit.

BRIEF DESCRIPTION OF THE DRAWINGS

FIGS. 3A to 3H are timing charts illustrating operations of the printer according to the first embodiment at the interruption of an AC input voltage.

FIGS. 6A to 6H are timing charts illustrating operations of the printer according to the first embodiment when the AC input voltage is instantaneously interrupted and is then restored.

FIGS. 9A to 9H are timing charts illustrating operations of the printer according to the second embodiment at the interruption of the AC input voltage.

FIGS. 10A to 10H are timing charts illustrating operations of the printer according to the second embodiment when the AC input voltage is instantaneously interrupted and is then restored.

DETAILED DESCRIPTION OF EMBODIMENTS

Figure 1:
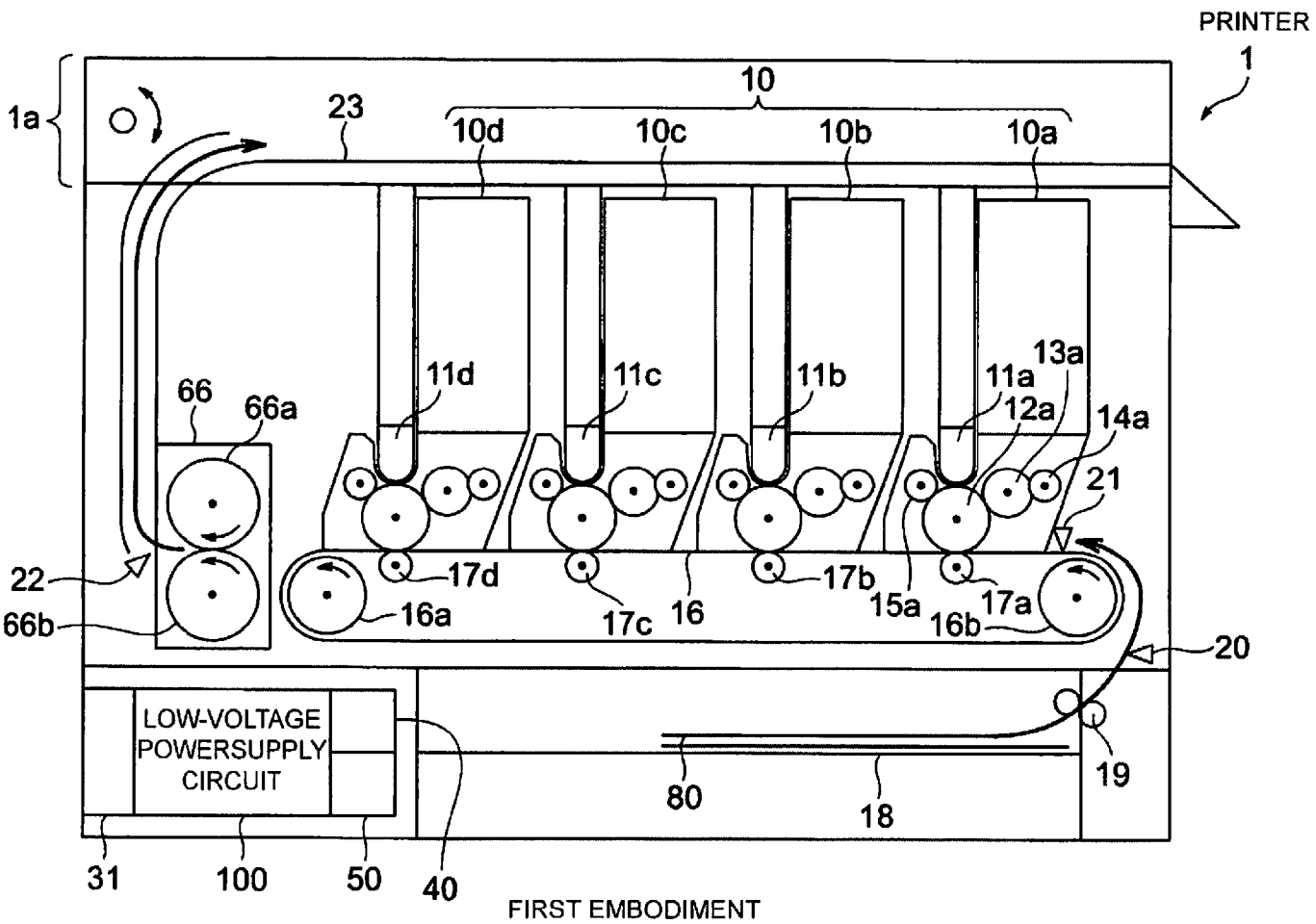
FIG. 1 is a diagram illustrating in schematic form a configuration of a printer according to a first embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

(1) First Embodiment

(1-1) Configuration of First Embodiment

FIG. 1 is a diagram illustrating in schematic form a configuration of printer 1 according to a first embodiment of the invention. Printer 1 is an electrophotographic color printer including a data processing device. Printer 1 may be other types of data processing apparatuses such as a monochrome printer, a copying machine, a facsimile device, and a multifunctional peripheral device. In the first embodiment, the data processing device includes a hard disk drive (HDD); however, the device included in the data processing device may be other devices (for example, a semiconductor storage device, a magnetic tape storage device, an optical disk recording device, and the like) which need a protective operation before stop.

As illustrated in FIG. 1, printer 1 includes four image formation units 10 (or 10*a*, 10*b*, 10*c*, 10*d*) configured to form developer images (or toner images) of colors on a printing medium (or a recording medium) 80 such as recording paper. Four image formation units 10 include K-color image formation unit 10*a* for black (K-color) image formation, C-color image formation unit 10*b* for cyan (C-color) image formation, M-color image formation unit 10*c* for magenta (M-color) image formation, and Y-color image formation unit 10*d* for yellow (Y-color) image formation. K-color image formation unit 10*a*, C-color image formation unit 10*b*, M-color image formation unit 10*c* and Y-color image formation unit 10*d* are arranged in sequence in a direction of conveyance of printing medium 80, or equivalently, in a direction from a feed side on which printing medium 80 is fed to an ejection side on which printing medium 80 is ejected (or in sequence in a direction from the right to the left in FIG. 1). K-color image formation unit 10*a* includes photoreceptor (or photoreceptor drum) 12*a* as an image carrier on which an electrostatic latent image is formed on an outer peripheral surface, charging roller 15*a* which uniformly charges the surface of photoreceptor 12*a*, exposure device 11*a* which exposes the uniformly charged surface of photoreceptor 12*a* according to image data to form an electrostatic latent image, development roller 13*a* which feeds toner as a developer to the surface of photoreceptor 12*a*, and feed roller 14*a* which feeds the toner to development roller 13*a*. Exposure device 11*a* includes a light source for exposure (for example, LED head 61, not shown in FIG. 1 and to be described later). Exposure devices 11*b*, 11*c*, 11*d* have the same configuration as that of exposure device 11*a*. C-color image formation unit 10*b*, M-color image formation unit 10*c* and Y-color image formation unit 10*d* each have the same structure as that of K-color image formation unit 10*a*. Note that the number of image formation units 10 is not limited to four, and any other number of image formation units 10 may be provided, provided that the number of image formation units 10 is equal to or more than one. Also, the structures and shapes of image formation units 10 are not limited to the example illustrated in FIG. 1, and image formation units 10 may have other structures and shapes.

Printer 1 includes, endless transfer belt 16 arranged under image formation units 10*a*, 10*b*, 10*c*, 10*d*, drive rollers 16*a*, 16*b* which move transfer belt 16 in a tensioned position, transfer rollers 17*a*, 17*b*, 17*c*, 17*d* arranged facing image formation units 10*a*, 10*b*, 10*c*, 10*d*, respectively, with transfer belt 16 in between, cassette tray 18 attached under transfer belt 16, hopping roller 19, paper feed sensor 20, write sensor 21, fixing device 66 including heating roller 66*a* and pressing roller 66*b*, and ejection sensor 22. Detection signals from paper feed sensor 20, write sensor 21 and ejection sensor 22 are transmitted to drive system controller 40. Drive system controller 40 determines the position of printing medium 80 and controls motors to operate the rollers and belt or the like for use in the conveyance of printing medium 80, based on the detection signals from paper feed sensor 20, write sensor 21 and ejection sensor 22. Heating roller 66*a* is provided internally with a halogen lamp as a heat source which produces heat by being supplied with electric power by low-voltage power supply circuit 100. A surface temperature of heating roller 66*a* is measured by a temperature detection unit such as a thermistor. Drive system controller 40 controls the power supply to the halogen lamp to control the surface temperature of heating roller 66*a*, based on information on the surface temperature of heating roller 66*a* obtained by the temperature detection unit.

During a printing operation, hopping roller 19 delivers printing media 80, one by one, stacked one on top of another and contained in cassette tray 18. Paper feed sensor 20 detects printing medium 80 delivered from cassette tray 18. Write sensor 21 is arranged at a position immediately before transfer roller 17*a*, and detects a write position at which toner images formed by image formation units 10*a*, 10*b*, 10*c*, 10*d* are to be transferred onto printing medium 80. Transfer belt 16 moves by the rotation of drive rollers 16*a*, 16*b*, and holds and conveys printing medium 80 on an outer peripheral surface. Transfer rollers 17*a*, 17*b*, 17*c*, 17*d* transfer the toner images formed on the surfaces of the photoreceptors of image formation units 10*a*, 10*b*, 10*c*, 10*d*, onto printing medium 80 being moved by transfer belt 16. Fixing device 66 applies heat and pressure to the toner images transferred onto printing medium 80 thereby to fix the toner images on printing medium 80. Ejection sensor 22 is arranged downstream of fixing device 66, and detects that printing medium 80 which has passed through fixing device 66 is ejected to stacker 23.

An upper portion of the housing of printer 1 is provided with openable/closable cover 1*a*. Cover 1*a* is mounted with exposure devices 11*a*, 11*b*, 11*c*, 11*d*, and closing of cover 1*a* allows exposure devices 11*a*, 11*b*, 11*c*, 11*d* to face the photoreceptors of image formation units 10*a*, 10*b*, 10*c*, 10*d*, respectively. An upper portion of cover 1*a* is provided with stacker 23 on which printing medium 80 ejected to the outside of the housing of printer 1 is to be placed.

Figure 2:
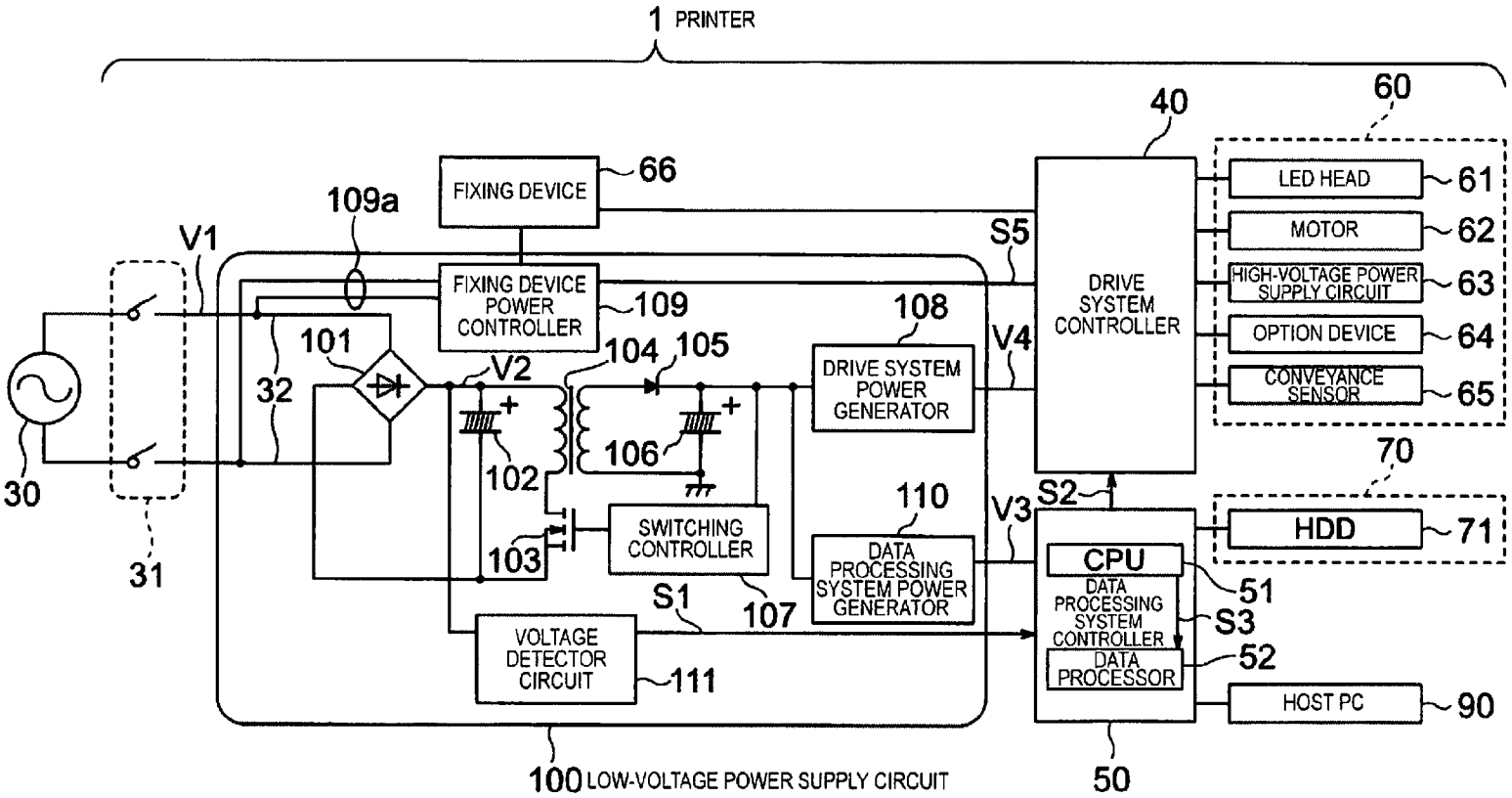
FIG. 2 is a block diagram illustrating in schematic form the configuration of the printer according to the first embodiment.

FIG. 2 is a block diagram illustrating in schematic form the configuration of printer 1 according to the first embodiment. As illustrated in FIG. 2, printer 1 includes power supply switch 31 which turns on or off AC input voltage V1 as an input voltage supplied by AC power supply 30. Also, printer 1 includes drive system device 60 which performs a printing operation, drive system controller 40 which controls drive system device 60, data processing device 70 which performs data processing, and data processing system controller 50 which controls data processing device 70. Also, printer 1 includes low-voltage power supply circuit 100 as a power supply circuit which generates drive system voltage V4 to be supplied to drive system controller 40 and data processing system voltage V3 to be supplied to data processing system controller 50, from AC input voltage V1 supplied by AC power supply 30 as an external power supply. Further, printer 1 includes voltage detector circuit 111 as an input voltage detector which transmits detection signal S1 indicating turn-off of AC input voltage V1 to data processing system controller 50, when AC input voltage V1 is turned off (or power supply from the external power supply is interrupted) in a first operation mode (or a normal operation mode) in which AC input voltage V1 is supplied to low-voltage power supply circuit 100 and the voltages are supplied to drive system controller 40 and data processing system controller 50. In an example of FIG. 1, voltage detector circuit 111 is illustrated as part of low-voltage power supply circuit 100; however, voltage detector circuit 111 may be configured separate from low-voltage power supply circuit 100. Upon receipt of detection signal S1 indicating the turn-off of AC input voltage V1, data processing system controller 50 switches an operation mode of a portion which does not affect a protective operation for data processing device 70, among structural components of printer 1, to a second operation mode (or a low power consumption mode) in which power consumption is lower than that in the first operation mode. Also, the second operation mode may stop an operation of the portion which does not affect the protective operation for data processing device 70. The portion which does not affect the protective operation for data processing device 70 includes, for example, at least one of a predetermined portion (for example, data processor 52) in data processing system controller 50 and a portion in drive system controller 40. When data processing system controller 50 switches the operation mode to the second operation mode, data processing system controller 50 executes the protective operation for data processing device 70. The protective operations include, for example, an operation for preventing physical damage to the data processing device, and an operation for saving (or storing) data (for example, data temporarily stored in a cache memory) not yet written on a storage unit of the data processing device (for example, a disk of an HDD) in the storage unit of the data processing device (for example, the disk of the HDD), which are performed during the turn-off of AC input voltage V1.

Low-voltage power supply circuit 100 includes rectifier diode bridge 101, electrolytic capacitor 102 as a capacitor or a power storage element, field effect transistor (or switching FET) 103, transformer 104, diode 105, electrolytic capacitor 106 as a capacitor or a power storage element, switching controller 107, drive system power generator 108, fixing device power controller 109, data processing system power generator 110, and voltage detector circuit 111.

Voltage V4 generated by drive system power generator 108 is supplied to drive system controller 40 and drive system device 60. Drive system power generator 108 generates from voltage V4 a 24-V voltage to be supplied to motor 62 or to high-voltage power supply circuit 63, a 5-V voltage to be supplied to LED head 61, a 24-V voltage to be supplied to option device 64 such as a scanner or an additional paper feed tray, and a 3.3-V voltage for use in a circuit such as a control ASIC (application specific integrated circuit) provided in drive system controller 40, and the like.

Voltage V3 generated by data processing system power generator 110 is supplied to data processing system controller 50 and data processing device 70. Data processing system power generator 110 generates from voltage V3 a 3.3-V voltage for use in CPU (central processing unit) 51 or data processor 52, and a 5-V voltage to operate data processing device 70 including hard disk drive (HDD) 71, and the like. Data processing system controller 50 can direct drive system controller 40 to change to the second operation mode (for example, a standby state or a power saving state) which effects greater power savings than the first operation mode, so as to be capable of directing drive system controller 40 to start and stop the printing operation. Also, voltage detector circuit 111 provided in low-voltage power supply circuit 100 is connected to data processing system controller 50, and data processing system controller 50 monitors a voltage of an input port of electrolytic capacitor 102.

Fixing device power controller 109 which supplies electric power to fixing device 66 receives AC input voltage V1 from fixing device power supply line 109*a*. Fixing device power supply line 109*a* is a line branched from control power supply line 32 of printer 1. Fixing device power controller 109 includes, for example, a triac as a structural element. Fixing device power controller 109 is connected to drive system controller 40 and fixing device 66, and supplies AC power to fixing device 66 in accordance with command signal S5 from drive system controller 40.

Control power supply line 32 is connected to an input port of rectifier diode bridge 101, and electric power rectified by rectifier diode bridge 101 is stored in electrolytic capacitor 102 connected to an output port of rectifier diode bridge 101. Typically, the capacitance of an electrolytic capacitor set for a low-voltage power supply circuit of a printer, not including data processing device 70, is set to a capacitance value capable of storing electric power sufficient to maintain the printing operation even at the occurrence of an instantaneous interruption (or instantaneous interruption within about 20 msec) of an AC input voltage specified by "voltage dips, short interruptions and voltage variations immunity tests" (hereinafter, sometimes called "voltage dips and other immunity tests") as determined by the International Electrotechnical Commission (IEC), supposing that the AC input voltage is instantaneously interrupted. In other words, printer 1 sets the capacitance value of electrolytic capacitor 102 such that electrolytic capacitor 102 can store enough electric power to continue the printing operation even at the occurrence of a voltage dip such as an instantaneous drop in AC input voltage V1 or the occurrence of an instantaneous power failure as an instantaneous power-off.

In the first embodiment, a capacitor capable of supplying electric power for a time required to complete the protective operation for data processing device 70 such as HDD 71, for power consumption in the low power consumption mode, in addition to capacitance capable of storing electric power for maintaining the printing operation at the occurrence of an instantaneous interruption of the input voltage as mentioned above, is adopted as electrolytic capacitor 102. In the case of an apparatus in which the time (or protective operation time) required for the protective operation for data processing device 70 such as HDD 71 is 50 msec, the capacitance of electrolytic capacitor 102 is set so to be capable of supplying electric power for 20 msec to be consumed for the printing operation and electric power for 50 msec to be consumed in the low power consumption mode. The amount of electric power storable in the low-voltage power supply circuit is calculated allowing for not only the capacitance of electrolytic capacitor 102 but also the capacitance of electrolytic capacitor 106. Typically, however, if a power supply voltage for use in a control circuit (for example, data processing system controller 50) is 5 V, an allowable power supply voltage is on the order of 5 V plus or minus 0.25 V. Thus, when the power supply voltage is 5 V, only a slight voltage drop of 0.25 V is allowed. Therefore, electric power stored in electrolytic capacitor 102 can be used until the electric power stored in electrolytic capacitor 102 becomes almost zero in order to maintain the voltage of electrolytic capacitor 106; however, electric power stored in electrolytic capacitor 106 can be slightly used.

Since the electric power stored in electrolytic capacitor 106 can be slightly used, a first embodiment description is therefore given that centers on the electric power stored in electrolytic capacitor 102. The electric power stored in electrolytic capacitor 102 is reduced in voltage by transformer 104 and switching FET 103 controlled by switching controller 107, and is reduced in voltage to a controller power supply voltage, such as a direct current (DC) voltage of 5 V, by rectifier diode bridge 101 and electrolytic capacitor 106. In FIG. 2, for the sake of simplicity of explanation, electrolytic capacitor 106 and rectifier diode bridge 101 are illustrated only as one system for the power supply voltage supply; however, in the case of a low-voltage power supply circuit in which plural outputs of transformer 104 are provided for one electrolytic capacitor 102, an output for a 24-V power supply voltage supply may be separately provided to supply a voltage to drive system controller 40. The electric power stored in electrolytic capacitor 106 is distributed between drive system power generator 108 and data processing system power generator 110. Drive system power generator 108 generates a 24-V voltage to be used by motor 62 or high-voltage power supply circuit 63 for use in drive system controller 40, a 5-V voltage to be used to turn on the LED head, a 24-V voltage to be supplied to option device 64 such as the scanner or the additional paper feed tray, and a 3.3-V voltage as a control voltage for the control ASIC (not illustrated) or the like provided in drive system controller 40, and the like.

(1-2) Operation of First Embodiment

FIGS. 3A to 3H are timing charts illustrating operations of printer 1 according to the first embodiment at the interruption of an AC input voltage. At time t1, printer 1 performs a normal printing operation (or the first operation mode). At this time, AC input voltage V1 (see FIG. 3A) supplied by AC power supply 30 is supplied through power supply switch 31 to fixing device power supply line 109*a* and control system power line 32 of low-voltage power supply circuit 100. Supplied AC input voltage V1 is a normal AC voltage (for example, a commercial AC voltage) as illustrated between time t1 and time t2 in FIG. 3A. Voltage detector circuit 111 detects voltage V2 (see FIG. 3B) outputted by rectifier diode bridge 101, and notifies data processing system controller 50 of detected voltage V2. At time t1, voltage V2 outputted by rectifier diode bridge 101 is equal to or more than predetermined threshold TH1. At this time, the amount of electric power stored in electrolytic capacitor 102 connected to the output port of rectifier diode bridge 101 connected to control system power line 32 is also maintained constant, and thus, the electric power stored in electrolytic capacitor 102 is reduced in voltage by transformer 104 and switching FET 103 controlled by switching controller 107, and is stably supplied as voltage V3 for data processing system controller 50 by rectifier diode bridge 101 and electrolytic capacitor 106.

At time t2, the occurrence of a power failure or user operation (for example, the removal of a power supply cable of printer 1 from a wall power supply socket) or the like interrupts the supply of power by AC input voltage V1 from AC power supply 30 to printer 1. A state which occurs at time t2 is the same state as an interrupted state by power supply switch 31. At time t2, the supply of power to fixing device power controller 109 and rectifier diode bridge 101 is interrupted. At time t2, as soon as the supply of power from AC power supply 30 is stopped, the supply of power to fixing device 66 is stopped. However, switching controller 107 attempts to maintain control system power by using electric power (or electric energy) stored in electrolytic capacitor 102 connected to the following stage of rectifier diode bridge 101 which generates a controller voltage. Incidentally, low-voltage power supply circuit 100 has a structure such that electrolytic capacitor 102 does not supply electric power to fixing device 66 through rectifier diode bridge 101 when the supply of AC power by AC input voltage V1 is interrupted. Thus, in order to maintain the voltage of electrolytic capacitor 106 by the electric power stored in electrolytic capacitor 102, switching controller 107 effects switching driving of switching FET 103 to allow electrolytic capacitor 106 to store the electric power converted by transformer 104.

After that, when the interruption of AC input voltage V1 from AC power supply 30 is continued, the electric power stored in electrolytic capacitor 102 decreases and voltage V2 of electrolytic capacitor 102 drops. At time t3, if voltage detector circuit 111 which monitors this voltage drop detects that voltage V2 drops to predetermined threshold TH1 set by voltage detector circuit 111, voltage detector circuit 111 transmits detection signal S1 (see FIG. 3D) indicating the interruption of AC input voltage V1 to data processing system controller 50.

Upon receipt of detection signal S1 indicating the interruption of AC input voltage V1, CPU 51 of data processing system controller 50 immediately starts the protective operation for HDD 71 at time t4 (see FIG. 3E). Typically, a storage unit of HDD 71 is a disk-shaped rotator (or a hard disk), and thus, data is temporarily stored in a volatile cache memory in HDD 71 until the disk-shaped rotator reaches a constant revolution speed. Thus, if the interruption of AC input voltage V1 occurs suddenly, a situation may arise where the hard disk as the storage unit of HDD 71 is physically destroyed or the data stored in the cache memory disappears. The following operation is performed in order to avoid such a situation; specifically, when the interruption of AC input voltage V1 occurs suddenly, a data saving operation as an operation for writing onto the hard disk data stored in the cache memory in HDD 71 and not yet written on the hard disk is first started at time t4 in order to safely stop HDD 71 (see FIG. 3E). At the same time as time t4 of the start of the protective operation, data processing system controller 50 reduces the amount of power consumption by drive system power generator 108, by transmitting power saving mode change command signal S2 (see FIG. 3F) to turn off LED head 61, stop motor 62, disconnect an output from high-voltage power supply circuit 63, stop an operation of option device 64 or do the like, to drive system controller 40, for the purpose of suppressing power consumption by electrolytic capacitor 102. When printer 1 is an apparatus having a standby state or a power saving mode, this control may be performed by issuing commands to switch the units to a power saving operation mode, rather than by issuing commands to shut-down operations of the units. In parallel with this operation, data processing system controller 50 internally reduces the amount of power consumption by data processing system power generator 110, by stopping clock S3 generated by CPU 51 and configured to control a memory operation of data processor 52, or by resetting an unnecessary function for data saving to the hard disk, and stopping a clock. Incidentally, the start of the protective operation illustrated in FIG. 3E, the transmission of detection signal S2 illustrated in FIG. 3F, the stop of the clock of data processor 52 illustrated in FIG. 3G, and the change of the mode of CPU 51 illustrated in FIG. 3H are all started at time t4; however, it is not necessarily required that these operations be started at the same time, and the start times may be more or less shifted.

After that, at time t5 (see FIG. 3E), an operation for retaining the data in the cache memory in HDD 71 in the hard disk in HDD 71 (or the data saving operation) is completed.

After that, at time t6 (see FIG. 3C), power supply voltage V3 received by data processing system controller 50 is less than operation limit voltage TH2; however, at time t5, the data saving as the protective operation in HDD 71 is completed, and thus, the data in HDD 71 does not disappear.

Figures 4A, 4B:
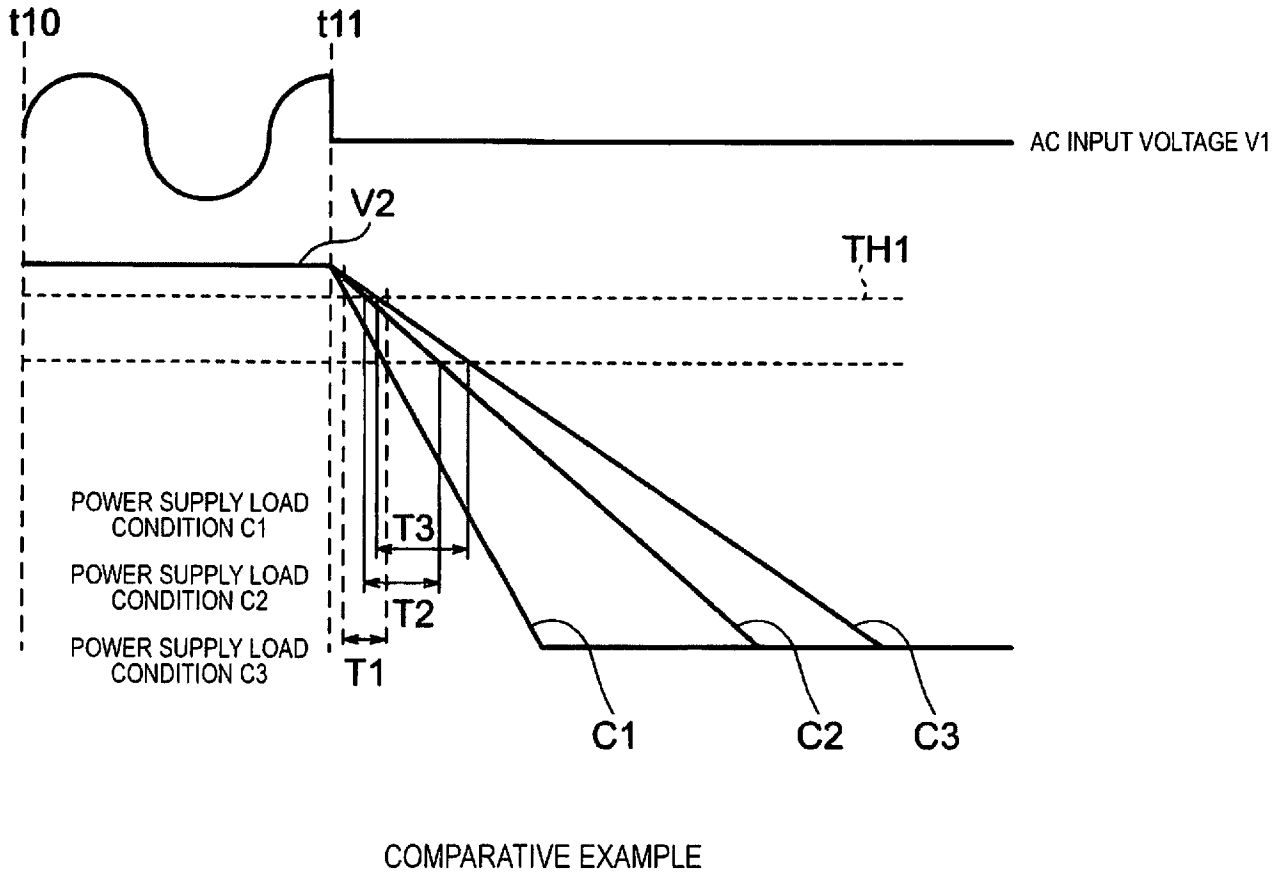
FIGS. 4A and 4B are waveform charts illustrating, under three types of load conditions, the transition of a voltage supplied to a data processing device after the interruption of the AC input voltage in a printer of a Comparative Example which does not change an operation mode at power-off.

FIGS. 4A and 4B are waveform charts illustrating, under three types of load conditions C1, C2, C3, the transition of a voltage supplied to HDD 71 as data processing device 70 after the interruption of AC input voltage V1 in a printer of Comparative Example which does not change an operation mode at power-off. FIG. 4A illustrates AC input voltage V1, and FIG. 4B illustrates the voltage supplied to HDD 71 (which corresponds to voltage V3 supplied to data processing system controller 50). As illustrated in FIGS. 4A and 4B, at time t10, AC input voltage V1 is stably supplied to low-voltage power supply circuit 100, and the apparatus operates under first power supply load condition (or first apparatus operation condition) C1 having the lowest power supply load, under second power supply load condition (or second apparatus operation condition) C2 having the second lowest power supply load, or under third power supply load condition (or third apparatus operation condition) C3 having the highest power supply load. After that, at time t11, when AC input voltage V1 is interrupted as illustrated in FIG. 4A, voltage V2 detected by voltage detector circuit 111 also gradually drops as illustrated in FIG. 4B. As illustrated in FIG. 4B, how voltage V2 drops varies according to the power supply load condition.

First apparatus operation condition C1 indicates an operation condition where the printing operation is executed. Condition C1 is a condition where motor 62 rotates, LED head 61 is on, and data processor 52 operates normally, and condition C1 indicates a condition where power consumption is high. Second apparatus operation condition C2 is a standby state in which motor 62 is stopped, LED head 61 is off, data processor 52 performs data processing so as to be capable of accepting a printing job, and the apparatus is ready to accept the printing job, and condition C2 indicates a condition where power consumption is medium. Third apparatus operation condition C3 indicates an operation condition intended to suppress power consumption. Condition C3 is a condition where motor 62 is stopped, LED head 61 is off, and data processor 52 is also stopped, and condition C3 indicates a condition where power consumption is slight. Under operation conditions having different power consumptions, such as first apparatus operation condition C1, second apparatus operation condition C2 and third apparatus operation condition C3, electric power stored in electrolytic capacitor 102 is used up in the shortest time under first apparatus operation condition C1, is used up in the second shortest time under second apparatus operation condition C2, and is used up in the longest time under third apparatus operation condition C3. Thus, the allowed time for the protective operation for HDD 71 in the case where AC input voltage V1 is interrupted under first apparatus operation condition C1 is significantly different from the allowed time in the case where AC input voltage V1 is interrupted under third apparatus operation condition C3. Thus, the rate of a drop in the power supply voltage varies according to the amount of power consumption varying according to the apparatus operation condition. Thus, in a conventional printer, a period of time between time t4 and time t6 in FIGS. 3B and 3C (or a period of time corresponding to T1, T2, T3 in FIG. 4B) varies according to the apparatus operation condition, and the time required for the protective operation for HDD 71 as data processing device 70 may not be ensured.

In the first embodiment, as soon as a drop in AC input voltage V1 is detected at time t3 (see FIG. 3B), the operation mode is changed to the power saving mode at time t4 (see FIG. 3D), and thus, there is no variation in the period of time between time t4 and time t6 according to the apparatus operation condition.

Figures 5A, 5B:
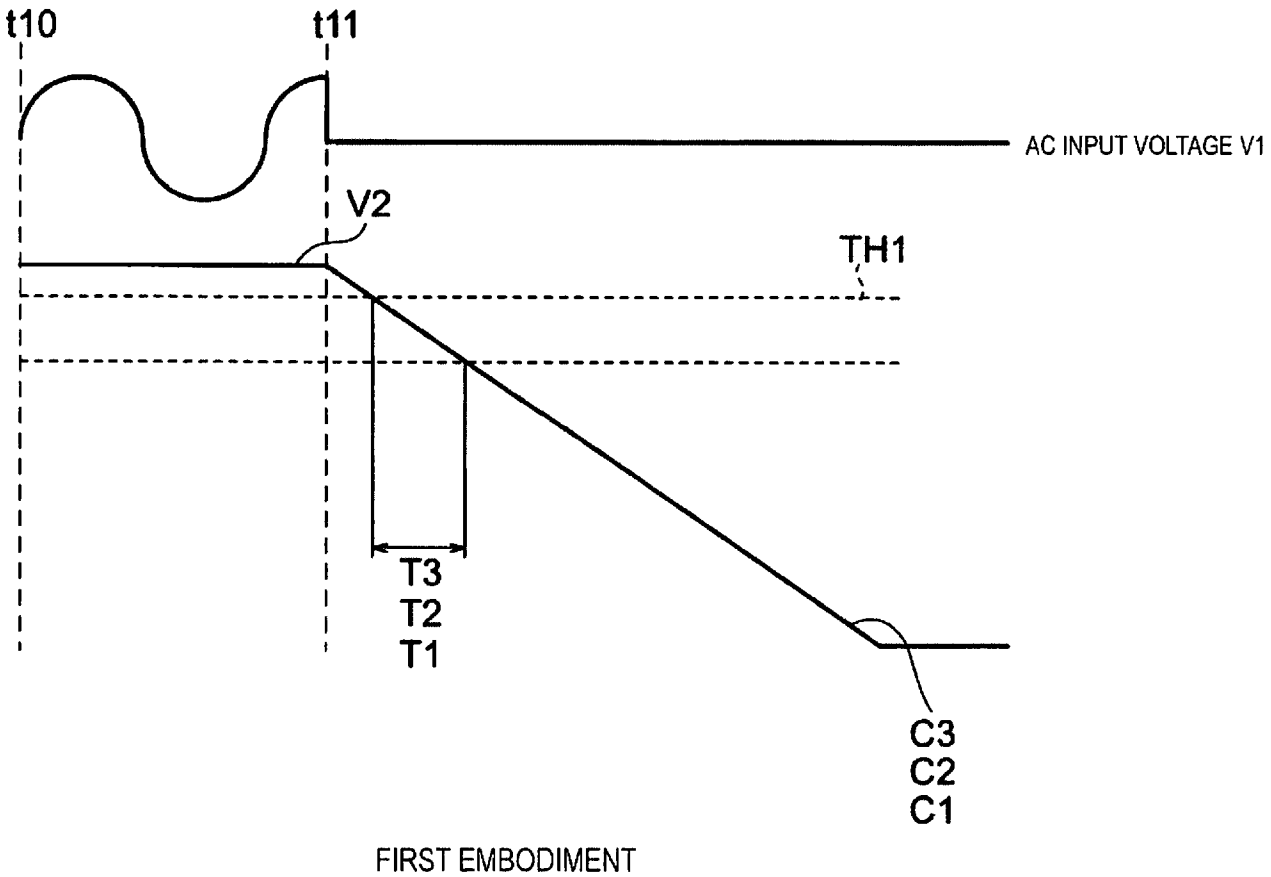
FIGS. 5A and 5B are waveform charts illustrating, under three types of load conditions, the transition of the voltage supplied to the data processing device after the interruption of the AC input voltage in the printer according to the first embodiment.

FIGS. 5A and 5B are waveform charts illustrating, under three types of load conditions C1, C2, C3, the transition of the voltage supplied to HDD 71 as data processing device 70 after the interruption of AC input voltage V1 in printer 1 according to the first embodiment. FIG. 5A illustrates AC input voltage V1, and FIG. 5B illustrates the voltage supplied to HDD 71 (which corresponds to voltage V3 supplied to data processing system controller 50). As illustrated in FIGS. 5A and 5B, at time t10, AC input voltage V1 is stably supplied to low-voltage power supply circuit 100, and the apparatus operates under first power supply load condition (or first apparatus operation condition) C1 having the lowest power supply load, under second power supply load condition (or second apparatus operation condition) C2 having the second lowest power supply load, or under third power supply load condition (or third apparatus operation condition) C3 having the highest power supply load. After that, at time t11, when AC input voltage V1 is interrupted as illustrated in FIG. 5A, voltage V2 detected by voltage detector circuit 111 also gradually drops as illustrated in FIG. 5B. As illustrated in FIG. 5B, voltage V2 drops slowly (or voltage V2 drops in a manner close to condition C3 in FIG. 4B illustrating Comparative Example), and voltage V2 drops in the same manner even under different power supply load conditions C1, C2, C3.

When time advances to time t6 (see FIG. 3C), switching controller 107 cannot maintain the voltage of electrolytic capacitor 106 only with the electric power stored in electrolytic capacitor 102, and output voltage V3 of data processing system power generator 110 connected to electrolytic capacitor 106 also drops. At time t6, voltage V3 maintained by electrolytic capacitor 106 drops to operation limit voltage TH2 of HDD 71; however, the protective operation for HDD 71 is already completed, and thus, at time t6, access to HDD 71 is stopped.

As described above, drive system controller 40 and data processing system controller 50 enter the power saving state as soon as AC input voltage V1 is interrupted, and thereby, electric power consumed by drive system controller 40 and data processing system controller 50 changes to the same low consumption operation mode regardless of the operation condition before the interruption of AC input voltage V1. As a result, the electric power stored in electrolytic capacitors 102 and 106 can be used only for the protective operation for HDD 71 to be performed by data processing system controller 50, and the time for the protective operation between time t4 and time t6 can be set with stability.

FIGS. 6A to 6H are timing charts illustrating operations of printer 1 according to the first embodiment when AC input voltage V1 is instantaneously interrupted and is then restored. FIG. 6A illustrates a case where, at time t2, the interruption of AC input voltage V1 occurs and, at time t3 immediately after that, AC input voltage V1 is restored to its normal state. A period of time between time t2 and time t3 is called instantaneous interruption or an instantaneous interruption period. FIG. 6B illustrates a case where the instantaneous interruption between time t2 and time t3 causes a temporary drop in detected voltage V2 (see V2*a* of FIG. 6B). At the occurrence of the instantaneous interruption of AC input voltage V1 for about 20 msec specified by "voltage dips and other immunity tests" provided supposing that the AC input voltage is instantaneously interrupted, voltage V2 detected by voltage detector circuit 111 is set so as not to reach operation limit voltage TH2 or less in the printing operation for 20 msec (or 1/50 of a second equivalent to a period of a wavelength of AC input voltage V1 having a frequency of 50 Hz). Thus, printer 1 can maintain a normal operation even at the occurrence of the instantaneous interruption of AC input voltage V1 for about 20 msec.

(1-3) Effect of First Embodiment

As described above, in printer 1 according to the first embodiment, as soon as the interruption of AC input voltage V1 is detected (at time t3 in FIGS. 3A to 3H), the operation mode changes to the low power consumption mode (or the second operation mode), and thereby, even if the interruption of AC input voltage V1 occurs under any operation condition, the rate of a drop in the voltage supplied by low-voltage power supply circuit 100 can be set to a presupposed constant rate. As a result, even if capacitors having low capacitance calculated based on power consumption in the low power consumption mode are used as electrolytic capacitors 102 and 106 of low-voltage power supply circuit 100, the time required for the protective operation for HDD 71 can be ensured with reliability during the interruption of AC input voltage V1, thereby to enable preventing damage to HDD 71 and the disappearance of data.

(2) Second Embodiment

(2-1) Configuration of Second Embodiment

Figure 7:
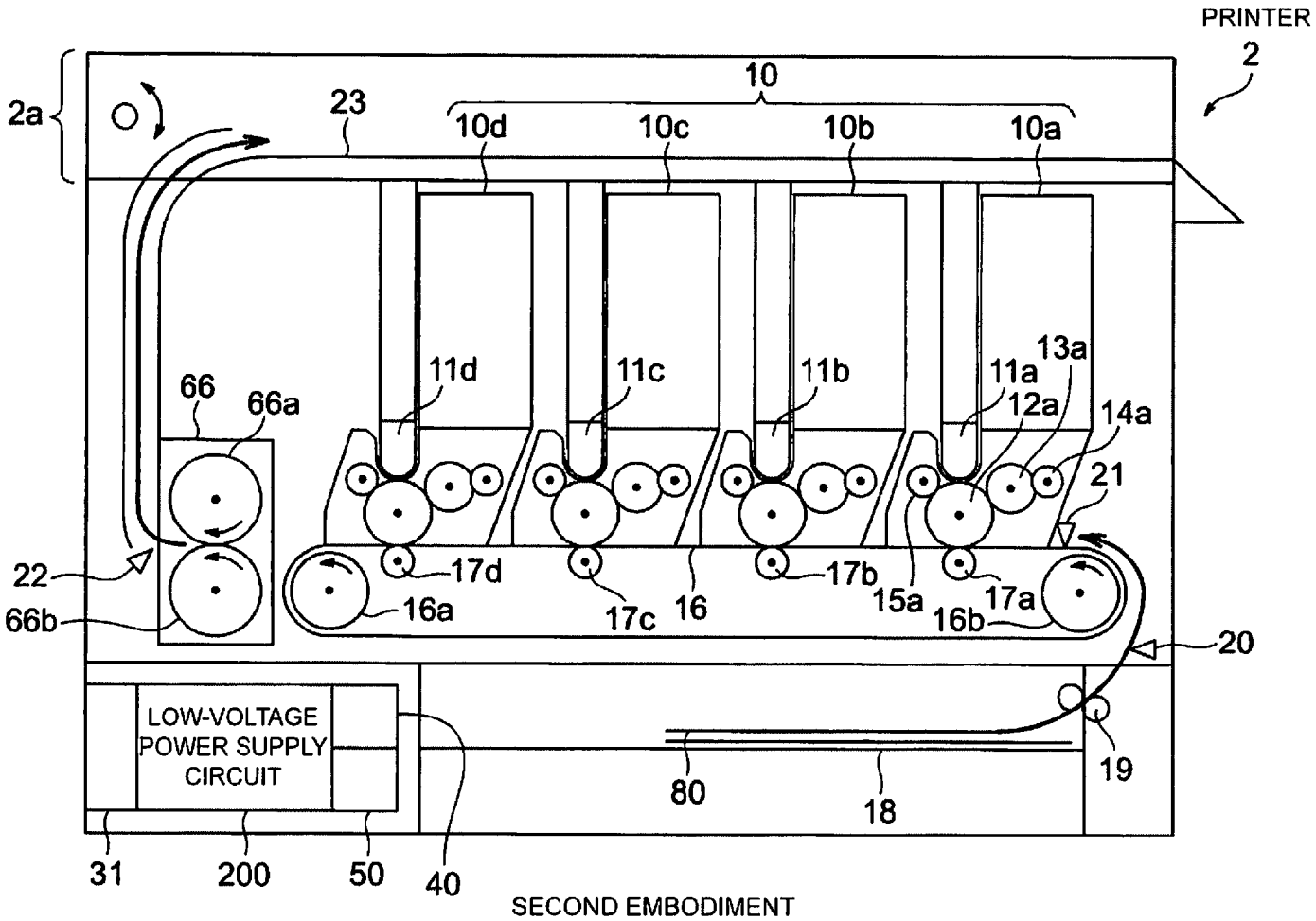
FIG. 7 is a diagram illustrating in schematic form a configuration of a printer according to a second embodiment of the invention.

FIG. 7 is a diagram illustrating in schematic form a configuration of printer 2 according to a second embodiment of the invention. In FIG. 7, structural elements identical or corresponding to the structural elements illustrated in FIG. 1 (the first embodiment) are indicated by the same reference numerals as the reference numerals given in FIG. 1. Printer 2 according to the second embodiment is different from printer 1 according to the first embodiment in a configuration of low-voltage power supply circuit 200. In the remaining respects, printer 2 according to the second embodiment is the same as printer 1 according to the first embodiment.

Figure 8:
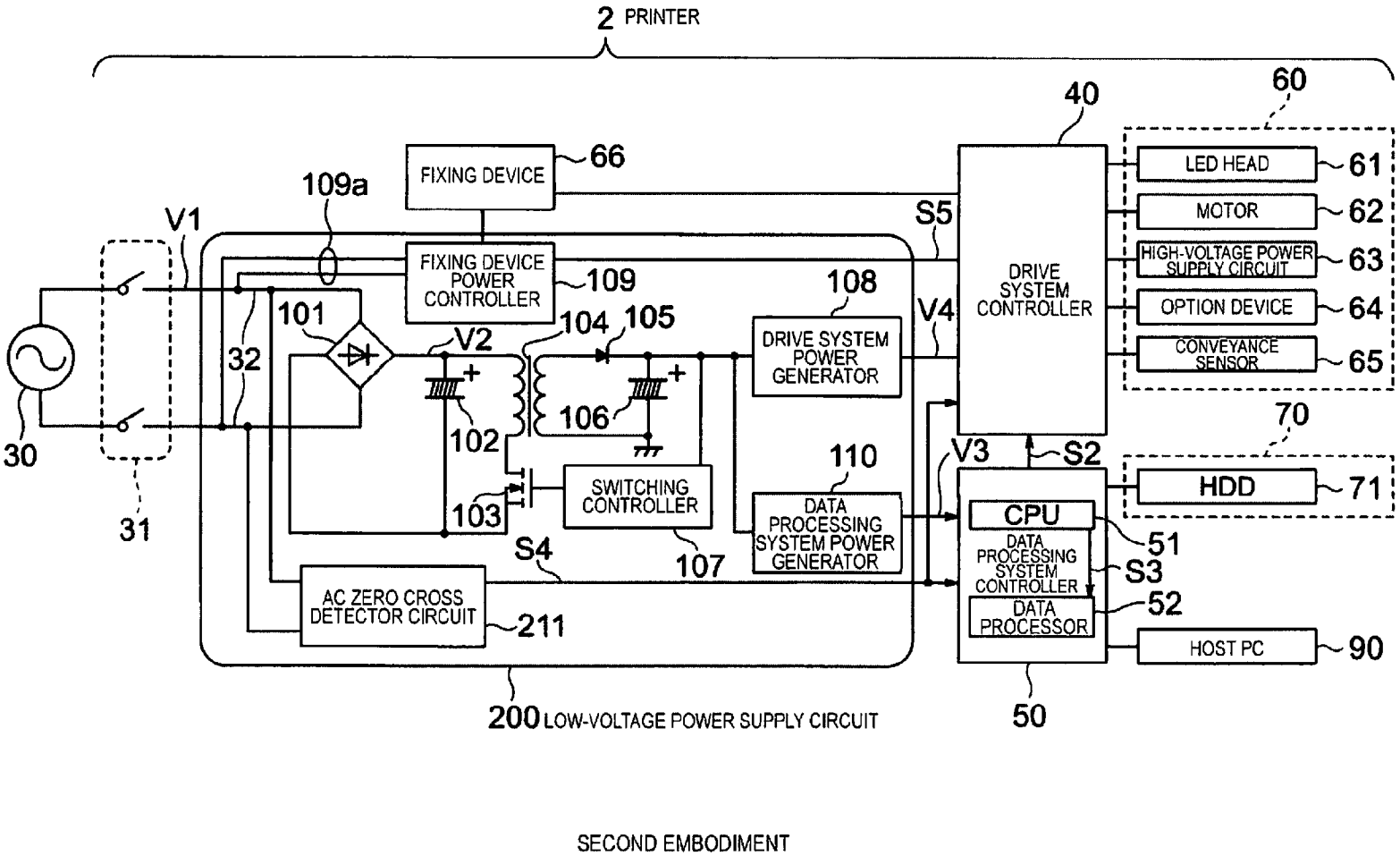
FIG. 8 is a block diagram illustrating in schematic form the configuration of the printer according to the second embodiment.

FIG. 8 is a block diagram illustrating in schematic form the configuration of printer 2 according to the second embodiment. In FIG. 8, structural elements identical or corresponding to the structural elements illustrated in FIG. 2 (the first embodiment) are indicated by the same reference numerals as the reference numerals given in FIG. 2. Printer 2 according to the second embodiment is different from printer 1 according to the first embodiment in the configuration of low-voltage power supply circuit 200. More specifically, low-voltage power supply circuit 200 of the second embodiment is different from low-voltage power supply circuit 100 of the first embodiment in which the interruption of AC input voltage V1 is indirectly detected by voltage detector circuit 111 detecting the voltage of the input port of electrolytic capacitor 102, in that the interruption of AC input voltage V1 is directly detected by AC zero cross detector circuit 211 as an input voltage detector. In the remaining respects, low-voltage power supply circuit 200 of the second embodiment is the same as low-voltage power supply circuit 100 of the first embodiment.

As illustrated in FIG. 8, AC zero cross detector circuit 211 is a circuit connected to both ends of power supply switch 31 and configured to directly detect AC input voltage V1. AC zero cross detector circuit 211 is a circuit which outputs a pulse signal each time AC input voltage V1 passes through 0 V as a reference level (or each time a waveform of AC input voltage V1 crosses 0 V (or a zero level)). An AC zero cross circuit which implements AC zero cross detector circuit 211 is a known circuit (refer to Japanese Patent Application Publication No. 2010-50820, for example). Output signal S4 from AC zero cross detector circuit 211 is transmitted to not only data processing system controller 50 but also to drive system controller 40. Drive system controller 40 is connected so that AC zero cross signal S4 can be utilized also as a trigger signal to start the supply of power to the halogen lamp of fixing device 66 at the time at which a voltage at an AC zero cross point is low, in order to suppress any excessively large inrush current generated during the supply of power to the halogen lamp as the heat source provided in fixing device 66, based on AC zero cross signal S4.

(2-2) Operation of Second Embodiment

FIGS. 9A to 9H are timing charts illustrating operations of printer 2 according to the second embodiment at the interruption of AC input voltage V1. At time t1, printer 2 performs a normal printing operation. At this time, AC input voltage V1 (see FIG. 9A) supplied by AC power supply 30 is supplied through power supply switch 31 to fixing device power supply line 109*a* and control system power line 32 of low-voltage power supply circuit 200. AC input voltage V1 is a normal AC voltage as illustrated between time t1 and time t2 in FIG. 9A. As illustrated between time t1 and time t2 in FIG. 9B, AC zero cross detector circuit 211 outputs a pulse signal each time AC input voltage V1 passes through 0 V as the reference level. At this time, the amount of electric power stored in electrolytic capacitor 102 connected to the output port of rectifier diode bridge 101 connected to control system power line 32 is also maintained constant. Thus, the electric power stored in electrolytic capacitor 102 is reduced in voltage by transformer 104 and switching FET 103 controlled by switching controller 107, and is stably supplied as voltage V3 for data processing system controller by rectifier diode bridge 101 and electrolytic capacitor 106. AC zero cross signal S4 as a detection signal indicating the interruption of AC input voltage V1 includes a pulse waveform having a constant period (e.g. a period of 10 msec when AC input voltage V1 is an alternating current having a frequency of 50 Hz). Data processing system controller 50 samples a rising edge of the pulse waveform of AC zero cross signal S4 and monitors the next rising edge. At this time, the amount of electric power stored in electrolytic capacitor 102 connected to the output port of rectifier diode bridge 101 is also maintained constant. Thus, the electric power stored in electrolytic capacitor 102 is reduced in voltage by transformer 104 and switching FET 103 controlled by switching controller 107, and is stably supplied as voltage V3 for data processing system controller by rectifier diode bridge 101 and electrolytic capacitor 106.

At time t2, the occurrence of a power failure or user operation or the like interrupts the supply of power from AC power supply 30 to printer 2. A state which occurs at time t2 is the same state as an interrupted state by power supply switch 31. At time t2, the supply of power to fixing device power controller 109 and rectifier diode bridge 101 is interrupted. At time t2, as soon as the supply of power from AC power supply 30 is stopped, the supply of power to fixing device 66 is stopped. However, switching controller 107 attempts to maintain control system power by using electric power stored in electrolytic capacitor 102 connected to the following stage of rectifier diode bridge 101 which generates a controller voltage. Incidentally, low-voltage power supply circuit 200 has a structure such that electrolytic capacitor 102 automatically stops supplying electric power to fixing device 66 through rectifier diode bridge 101 when the supply of power by AC input voltage V1 is interrupted. Thus, in order to maintain the voltage of electrolytic capacitor 106 by the electric power stored in electrolytic capacitor 102, switching controller 107 effects switching driving of switching FET 103 to allow electrolytic capacitor 106 to store the electric power converted by transformer 104.

After that, when the interruption of AC input voltage V1 from AC power supply 30 is continued, the electric power stored in electrolytic capacitor 102 decreases and voltage V2 of electrolytic capacitor 102 drops in the same manner as the first embodiment (see FIG. 9C). After time t2 of the interruption of AC input voltage V1, data processing system controller 50 samples a rising edge of the pulse waveform of AC zero cross signal S4 and monitors the next rising edge. After 10 msec as the next detection period, if the next rising edge is not detected, data processing system controller 50 starts an operation for temporarily stopping acceptance of the next printing job or updating consumable longevity information as accumulated data, or equivalently, a preparation operation for bringing the power supply of the apparatus into a state capable of interruption, while avoiding a sudden stop of the printing operation (see FIG. 9H).

At time t3, in preparation for the influence of noise upon AC zero cross signal S4 or the occurrence of the instantaneous interruption of AC input voltage V1 for about 20 msec specified by "voltage dips and other immunity tests" supposing that AC input voltage V1 is instantaneously interrupted, it is detected that a state in which the pulse waveform of AC zero cross signal S4 is not detected continues for 30 msec or more (i.e. a period equivalent to or longer than a 1.5 wavelength at a frequency of 50 Hz) after detection of the rising edge of the pulse waveform of AC zero cross signal S4. When the state in which the pulse waveform of AC zero cross signal S4 is not detected continues for 30 msec or more, CPU 51 of data processing system controller 50 starts the protective operation for HDD 71 at time t4 (see FIG. 9E).

Here, the reason why the protective operation is started when the state in which the pulse waveform of AC zero cross signal S4 is not detected continues for 30 msec or more is as follows. If CPU 51 of data processing system controller 50 is set to start the protective operation for HDD 71 when the state in which the pulse waveform of AC zero cross signal S4 is not detected continues for "20 msec or more," a problem arises as given below. When AC input voltage V1 is interrupted immediately after the rising edge of the pulse waveform of AC zero cross signal S4, if the pulse waveform of AC zero cross signal S4 is not detected for 20 msec or more, a determination can be made that AC input voltage V1 is interrupted. However, when AC input voltage V1 is interrupted immediately before the rising edge of the pulse waveform of AC zero cross signal S4, the state in which the pulse waveform of AC zero cross signal S4 is not detected already elapses for about 10 msec. Thus, at the time of a lapse of about 10 msec after the time of the interruption of AC input voltage V1, a determination is made that AC input voltage V1 is interrupted. In other words, when AC input voltage V1 is interrupted immediately before the rising edge of the pulse waveform of AC zero cross signal S4, after a lapse of about 10 msec, rather than after a lapse of 20 msec, after the time of the interruption of AC input voltage V1, a determination is made that AC input voltage V1 is interrupted. Thus, at the occurrence of the instantaneous interruption (or short interruption) of AC input voltage V1 for a period of 10 msec, the printing operation cannot be maintained and may be stopped. In the above respect, it is desirable that the operations be performed as given below; specifically, when the next rising edge of the pulse waveform of AC zero cross signal S4 is not detected at the time of a lapse of 10 msec after the detection of the rising edge of the pulse waveform of AC zero cross signal S4, CPU 51 starts the preparation operation for changing to the low power consumption mode (see FIG. 9H) and further waits for 20 msec, and consequently, after 30 msec after the detection of the last rising edge of the pulse waveform of AC zero cross signal S4, CPU 51 starts the protective operation for HDD 71.

As described above, the preparation operation is started after a lapse of 10 msec after the rising of the pulse waveform of AC zero cross signal S4, and thereby, the 20-msec preparation operation time can be ensured with reliability. However, when a power supply environment is not good, it is necessary to take the influence of noise or the like into account. As illustrated for example in FIG. 9B, when noise is erroneously detected as the rising edge of the pulse waveform until the time of a lapse of 30 msec after the detection of the pulse waveform of AC zero cross signal S4, a need to redo a restoration operation arises. As a result, the preparation operation is frequently repeated, and a situation may arise where a load of CPU 51 increases. Therefore, a setting may be made to start the preparation operation after a lapse of a longer time (for example, 15 msec), rather than after a lapse of 10 msec, after the rising edge of the pulse waveform of AC zero cross signal S4, thereby to reduce the likelihood of occurrence of frequent repetition of the preparation operation.

After that, at time t4 (see FIG. 9E), upon receipt of AC zero cross signal S4, CPU 51 of data processing system controller 50 immediately starts the protective operation for HDD 71. Typically, HDD 71 temporarily stores data in the volatile cache memory. Thus, if the interruption of AC input voltage V1 occurs suddenly, the protective operation (or data saving) for writing onto the hard disk data retained in the cache memory but not yet written on the hard disk is necessary. At time t4 of start of the protective operation, data processing system controller 50 reduces the amount of power consumption by drive system power generator 108, by transmitting power saving mode change command signal S2 (see FIG. 9F) to turn off LED head 61, stop motor 62, disconnect the output from high-voltage power supply circuit 63, stop the operation of option device 64 or do the like, to drive system controller 40, so as to achieve low power consumption for the purpose of suppressing power consumption by electrolytic capacitor 102. When printer 2 is an apparatus having the standby state or the power saving mode, this control may be performed by issuing commands to switch the units to the power saving operation mode, rather than by issuing commands to shutdown operations of the units. At the same time, data processing system controller 50 internally reduces the amount of power consumption by data processing system power generator 110, by stopping clock S3 generated by CPU 51 and configured to control the memory operation of data processor 52, or by resetting an unnecessary function for data saving to the hard disk, and stopping a clock. Incidentally, the start of the protective operation illustrated in FIG. 9E, the transmission of stop command signal S2 illustrated in FIG. 9F, command S3 to stop the clock of data processor 52 illustrated in FIG. 9G, and the change of the mode of CPU 51 illustrated in FIG. 9H are all started at time t4; however, it is not necessarily required that these operations be started at the same time, and the start times may be more or less shifted.

After that, at time t5 (see FIG. 9E), the data saving operation for retaining the data in the cache memory in HDD 71 in the hard disk in HDD 71 is completed.

Power supply voltage V3 received by data processing system controller 50 drops at time t21, and, at time t6, power supply voltage V3 received by data processing system controller 50 becomes less than operation limit voltage TH2 (see FIG. 9D); however, at time t5, the protective operation in HDD 71 is completed (see FIG. 9E), and thus, the data in HDD 71 does not disappear.

FIGS. 10A to 10H are timing charts illustrating operations of printer 2 according to the second embodiment when AC input voltage V1 is instantaneously interrupted and is then restored. FIG. 10A illustrates a case where, at time t2, the interruption of AC input voltage V1 occurs and, at time t3 immediately after that, AC input voltage V1 is restored to its normal state. A period of time between time t2 and time t3 is called instantaneous interruption or an instantaneous interruption period. FIG. 10B illustrates a case where the pulse waveform of AC zero cross signal S4 is not generated due to the instantaneous interruption between time t2 and time t3. At the occurrence of the instantaneous interruption of AC input voltage V1 for about 20 msec specified by "voltage dips and other immunity tests" specified supposing that the AC input voltage is instantaneously interrupted, AC zero cross detector circuit 211 does not notify data processing system controller 50 of the pulse waveform of AC zero cross signal S4, and, during the period of time between time t2 and time t3, CPU 51 performs the preparation operation for the protective operation such as data saving; however, at time t3, AC input voltage V1 is restored, and thus, the normal operation can be maintained even during the period of time between time t2 and time t3.

(2-3) Effect of Second Embodiment

As described above, in printer 2 according to the second embodiment, as soon as a drop in AC input voltage V1 is detected (at time t3 in FIGS. 9A to 9H), the operation mode changes to the low power consumption mode, and thereby, even if the interruption of AC input voltage V1 occurs under any operation condition, the rate of the drop in the voltage supplied by low-voltage power supply circuit 200 can be set to a presupposed constant rate or lower. As a result, even if capacitors having a low capacitance, calculated based on power consumption in the low power consumption mode, are used as electrolytic capacitors 102 and 106 of low-voltage power supply circuit 200, the time required for the stable protective operation for HDD 71 can be ensured during the interruption of AC input voltage V1 to thus enable preventing damage to HDD 71 and disappearance of data.

Also, in printer 2 according to the second embodiment, the detection of the pulse waveform of AC zero cross signal S4 enables more rapid detection of a voltage drop, thus enabling CPU 51 to early start the preparation operation for the data saving in HDD 71. Thus, the amount of data savable in HDD 71 increases, and thus, at the interruption of the AC input voltage, the protective operation performed in HDD 71 can be completed with reliability.

Also, in printer 2 according to the second embodiment, even at the occurrence of temporary interruption of AC input voltage V1 due to instantaneous power failure, a drop in AC input voltage V1 can be predicted from electric power consumed during the printing operation, and thus, the circuit which presets threshold TH1 in the first embodiment is unnecessary.

(3) Modifications

In the above-described first and second embodiments, the protective operation is described by way of example as stopping the operation of HDD 71; however, the invention is not so limited but is applicable to a protective operation for a data processing apparatus as a device (or a peripheral device) for use in data processing.

Also, in the above-described first and second embodiments, an example is given in which CPU 51 transmits operation stop command signal S2 to drive system controller 40 thereby to save consumption of electric power stored in low-voltage power supply circuit 100 (or 200). However, a configuration may be adopted such that CPU 51 transmits a command signal to stop drive system power generator 108 from generating electric power to low-voltage power supply circuit 100 (or 200) thereby to save consumption of electric power stored in low-voltage power supply circuit 100 (or 200). In this case, the operation can change to a stopping operation for printer 1 after reliable completion of the protective operation for data processing device 70 such as HDD 71, as is the case with the effects described in the above-described first and second embodiments.

Also, in the above-described first and second embodiments, a description is given with regard to an example in which low-voltage power supply circuit 100 (or 200) includes drive system power generator 108 and data processing system power generator 110. However, a configuration may be adopted such that drive system power generator 108 and data processing system power generator 110 are replaced by one power generator or are replaced by three or more power generators.

Also, in the above-described first and second embodiments, a scanner device is given by way of example as option device 64; however, any other device may be used as option device 64, provided that the device is switchable to the low power consumption mode or is capable of stopping the power supply of the apparatus in response to a command signal from data processing system controller 50.

Also, a method of controlling a data processing apparatus to which the invention is applied may be a method including a drive system device, a data processing device configured to perform data processing, and a power supply circuit configured to generate a drive system voltage to be supplied to the drive system device and a data processing system voltage to be supplied to the data processing device, from an input voltage from an external power supply, in which, when an interruption of the input voltage is detected, switching is performed to change to a power saving mode in which the drive system device is stopped or restrained from driving, and thereafter, a protective operation for the data processing device is executed.

Also, in the above-described first embodiment, voltage detector circuit 111 detects voltage V2 in low-voltage power supply circuit 100; however, an AC zero cross detector circuit may be used to detect voltage V2.

The invention is applicable to an electrophotographic printer, a copying machine, a facsimile device, and an apparatus having a printing function such as MFP. Also, the invention is applicable to a data processing apparatus including a data processing device which needs a protective operation at the time of the interruption of an input voltage.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A printer comprising:

a drive system device configured to perform a printing operation;

a drive system controller configured to control the drive system device;

a data processing device configured to perform data processing;

a data processing system controller configured to control the data processing device;

a power supply circuit configured to generate a drive system voltage to be supplied to the drive system controller and a data processing system voltage to be supplied to the data processing system controller, from an input voltage supplied by an external power supply; and an input voltage detector configured to transmit a detection signal indicative of an interruption of the input voltage to the data processing system controller, when the input voltage is interrupted in a first operation mode in which the drive system voltage and the data processing system voltage are supplied to the drive system controller and the data processing system controller, wherein, upon receipt of the detection signal indicating the interruption of the input voltage, the data processing system controller switches at least one of a predetermined portion in the data processing system controller and the drive system controller to a second operation mode in which power consumption is lower than that in the first operation mode, and executes a protective operation for the data processing device, wherein the power supply circuit includes a capacitor configured to store electric power by the input voltage in the first operation mode, and the electric power stored in the capacitor is used for the protective operation for the data processing device in the second operation mode, and wherein the input voltage detector is a voltage detector circuit configured to detect a voltage of an input port of the capacitor and transmit the detection signal indicating the interruption of the input voltage to the data processing system controller when the voltage of the input port of the capacitor becomes lower than a predetermined threshold.

2. The printer according to claim 1, wherein the input voltage is an AC input voltage, the power supply circuit includes a rectifier circuit configured to rectify the AC input voltage, and an output port of the rectifier circuit is connected to the input port of the capacitor.

3. The printer according to claim 1, wherein the data processing system controller includes a data processor, and a central controller configured to transmit a control signal to the data processor and the drive system controller, and the predetermined portion in the data processing system controller is the data processor.

4. The printer according to claim 1, wherein the data processing device includes a hard disk drive.

5. The printer according to claim 1, wherein the drive system device includes at least one of a motor, a sensor, a high-voltage power supply circuit and a light emitting element to execute the printing operation.

6. The printer according to claim 1, wherein the input voltage detector constitutes a part of the power supply circuit.

7. The printer according to claim 1, wherein the threshold is determined such that the time at which the input voltage detector transmits the detection signal indicating the interruption of the input voltage to the data processing system controller when the input voltage is interrupted in the first operation mode is earlier than the time at which a data processing voltage which the data processing system controller supplies to the data processing device becomes lower than an operation limit voltage of the data processing device.

8. The printer according to claim 1, wherein the threshold is determined such that the dropped voltage of the input port of the capacitor does not reach an operation limit voltage of the data processing device when the input voltage in the first operation mode is restored after an instantaneous interruption for a time specified by voltage dips, short interruptions and voltage variations immunity tests.

9. The printer according to claim 1, wherein, upon receipt of the detection signal indicating the interruption of the input voltage, the data processing system controller executes the protective operation for the data processing device even before a lapse of the time specified by the voltage dips, short interruptions and voltage variations immunity tests.

10. A data processing apparatus comprising:

a drive system device;

a drive system controller configured to control the drive system device;

a data processing device configured to perform data processing;

a data processing system controller configured to control the data processing device;

a power supply circuit configured to generate a drive system voltage to be supplied to the drive system controller and a data processing system voltage to be supplied to the data processing system controller, from an input voltage supplied by an external power supply; and an input voltage detector configured to transmit a detection signal indicating an interruption of the input voltage to the data processing system controller, when the input voltage is interrupted in a first operation mode in which the voltages are supplied to the drive system controller and the data processing system controller, wherein, upon receipt of the detection signal indicating the interruption of the input voltage, the data processing system controller switches at least one of a predetermined portion in the data processing system controller and the drive system controller to a second operation mode in which power consumption is lower than that in the first operation mode, and executes a protective operation for the data processing device, wherein the power supply circuit includes a capacitor configured to store electric power by the input voltage in the first operation mode, and the electric power stored in the capacitor is used for the protective operation for the data processing device in the second operation mode, and wherein the input voltage detector is a voltage detector circuit configured to detect a voltage of an input port of the capacitor and transmit the detection signal indicating the interruption of the input voltage to the data processing system controller when the voltage of the input port of the capacitor becomes lower than a predetermined threshold.

11. The printer according to claim 10, wherein the input voltage is an AC input voltage, and the input voltage detector includes an AC zero cross detector circuit.

12. The printer according to claim 11, wherein the power supply circuit includes a rectifier circuit configured to rectify the AC input voltage, and an output port of the rectifier circuit is connected to the input port of the capacitor.

13. The data processing apparatus according to claim 10, wherein the input voltage is an AC input voltage, the power supply circuit includes a rectifier circuit configured to rectify the AC input voltage, and an output port of the rectifier circuit is connected to the input port of the capacitor.

14. The data processing apparatus according to claim 10, wherein the threshold is determined such that the time at which the input voltage detector transmits the detection signal indicating the interruption of the input voltage to the data processing system controller when the input voltage is interrupted in the first operation mode is earlier than the time at which a data processing voltage which the data processing system controller supplies to the data processing device becomes lower than an operation limit voltage of the data processing device.

15. The data processing apparatus according to claim 10, wherein the threshold is determined such that the dropped voltage of the input port of the capacitor does not reach an operation limit voltage of the data processing device when the input voltage in the first operation mode is restored after an instantaneous interruption for a time specified by voltage dips, short interruptions and voltage variations immunity tests.

16. The data processing apparatus according to claim 10, wherein the data processing system controller includes a data processor, and a central controller configured to transmit a control signal to the data processor and the drive system controller, and the predetermined portion in the data processing system controller is the data processor.

17. The data processing apparatus according to claim 10, wherein the data processing device includes a hard disk drive.

18. The data processing apparatus according to claim 10, wherein the drive system device includes at least one of a motor, a sensor, a high-voltage power supply circuit and a light emitting element to execute the printing operation.

19. The data processing apparatus according to claim 10, wherein the input voltage detector constitutes a part of the power supply circuit.

20. The data processing apparatus according to claim 10, wherein, upon receipt of the detection signal indicating the interruption of the input voltage, the data processing system controller executes the protective operation for the data processing device even before a lapse of the time specified by the voltage dips, short interruptions and voltage variations immunity tests.

21. A data processing apparatus comprising:

a drive system device;

a drive system controller configured to control the drive system device;

a data processing device configured to perform data processing;

a data processing system controller configured to control the data processing device;

a power supply circuit configured to generate a drive system voltage to be supplied to the drive system controller and a data processing system voltage to be supplied to the data processing system controller, from an input voltage supplied by an external power supply; and an input voltage detector configured to transmit a detection signal indicating an interruption of the input voltage to the data processing system controller, when the input voltage is interrupted in a first operation mode in which the voltages are supplied to the drive system controller and the data processing system controller, wherein, upon receipt of the detection signal indicating the interruption of the input voltage, the data processing system controller switches at least one of a predetermined portion in the data processing system controller and the drive system controller to a second operation mode in which power consumption is lower than that in the first operation mode, and executes a protective operation for the data processing device, wherein the input voltage is an AC input voltage, wherein the input voltage detector includes an AC zero cross detector circuit, wherein the power supply circuit includes a rectifier circuit configured to rectify the AC input voltage, and wherein an output port of the rectifier circuit is connected to the input port of the capacitor.

22. The data processing apparatus according to claim 21, wherein the power supply circuit includes a capacitor configured to store electric power by the input voltage in the first operation mode, and the electric power stored in the capacitor is used for the protective operation for the data processing device in the second operation mode.

23. The data processing apparatus according to claim 22, wherein the input voltage detector is a voltage detector circuit configured to detect a voltage of an input port of the capacitor and transmit the detection signal indicating the interruption of the input voltage to the data processing system controller when the voltage of the input port of the capacitor becomes lower than a predetermined threshold.

24. The data processing apparatus according to claim 23, wherein the input voltage is an AC input voltage, the power supply circuit includes a rectifier circuit configured to rectify the AC input voltage.

25. The data processing apparatus according to claim 23, wherein the threshold is determined such that the time at which the input voltage detector transmits the detection signal indicating the interruption of the input voltage to the data processing system controller when the input voltage is interrupted in the first operation mode is earlier than the time at which a data processing voltage which the data processing system controller supplies to the data processing device becomes lower than an operation limit voltage of the data processing device.

26. The data processing apparatus according to claim 23, wherein the threshold is determined such that the dropped voltage of the input port of the capacitor does not reach an operation limit voltage of the data processing device when the input voltage in the first operation mode is restored after an instantaneous interruption for a time specified by voltage dips, short interruptions and voltage variations immunity tests.

* * * * *